United States Patent [19]

Smith et al.

[11] Patent Number: 4,695,050

[45] Date of Patent: Sep. 22, 1987

[54] EXERCISE ROWING MACHINE

[75] Inventors: David B. Smith, Mercer Island; Randolph F. Miller, Mt. Vernon, both of Wash.

[73] Assignee: Precor Incorporated, Redmond, Wash.

[21] Appl. No.: 776,400

[22] Filed: Sep. 16, 1985

[51] Int. Cl.[4] ..... A63B 69/06

[52] U.S. Cl. ..... 272/72; 272/130

[58] Field of Search ..... 272/70, 72, 69, 118, 272/127, 132, 134, 130, 93, 117; D21/191-195

[56] References Cited

U.S. PATENT DOCUMENTS

| | | | |
|---|---|---|---|
| D. 211,801 | 7/1968 | Quinton . | |
| D. 265,110 | 6/1982 | Lafont . | |
| D. 268,194 | 3/1983 | Smith . | |
| D. 268,277 | 3/1983 | Smith . | |
| D. 268,278 | 3/1983 | Smith . | |
| D. 270,555 | 9/1983 | Ogden . | |
| D. 273,029 | 3/1984 | Kullenberg . | |
| D. 277,304 | 1/1985 | Smith et al. . | |
| 682,988 | 9/1901 | Hazelip . | |
| 1,905,019 | 4/1933 | Turner . | |
| 2,733,922 | 2/1956 | Diego . | |
| 2,783,045 | 2/1957 | Bosch . | |
| 3,010,720 | 11/1961 | Allard . | |
| 3,130,968 | 4/1964 | De Feen | 272/134 X |
| 3,635,472 | 1/1972 | Marlyan | 272/118 |
| 3,643,943 | 2/1972 | Erwin, Jr. et al. . | |
| 3,658,327 | 4/1972 | Thiede . | |
| 3,708,167 | 1/1973 | Potgieter . | |
| 3,770,267 | 11/1973 | McCarthy . | |
| 3,892,404 | 7/1975 | Martucci . | |
| 4,004,801 | 1/1977 | Campanaro et al. . | |
| 4,101,124 | 7/1978 | Mahnke . | |
| 4,284,272 | 8/1981 | Evans et al. . | |
| 4,286,782 | 9/1981 | Fuhrhop . | |
| 4,324,399 | 4/1982 | Rickey . | |
| 4,477,071 | 10/1984 | Brown et al. . | |
| 4,506,884 | 3/1985 | Hankin | 272/127 |
| 4,541,627 | 9/1985 | MacLean et al. . | |

FOREIGN PATENT DOCUMENTS

| | | | |
|---|---|---|---|
| 161441 | 9/1904 | Fed. Rep. of Germany | 272/72 |
| WO 82/01138 | 4/1982 | World Int. Prop. O. . | |
| 78675 | 4/1932 | Sweden . | |
| 390424 | 4/1933 | United Kingdom | 272/72 |
| 462410 | 5/1935 | United Kingdom . | |
| 2120560 | 12/1983 | United Kingdom . | |

OTHER PUBLICATIONS

Cover and pp. 20 and 21 of The Sharper Image, Sep. 1985 catalog showing Tunturi Rower 2, Compact Rower and ProForm Contour II Electronic Rower.

Advertising brochure by Bremshey Sport illustrating the Tunturi Rower GL and Heimrudergerat R1 rowing machines.

Two-page brochure illustrating the Carbos Models F130, F120 and F110 rowing machines.

Brochure for the Model OmniRow XL rowing machine by Maclevy.

(List continued on next page.)

*Primary Examiner*—Richard J. Apley
*Assistant Examiner*—J. Welsh
*Attorney, Agent, or Firm*—Christensen, O'Connor, Johnson & Kindness

[57] ABSTRACT

An exercise rowing machine includes a frame (10) constructed with a longitudinal beam structure (12) overlying a forward substructure (14) A seat (24) is mounted on an underlying carriage assembly (26) having rollers (138) and (140) which ride on upper and lower rails (114) and (120) of a first track (110), and rollers (150) which ride on upper and lower rails (122) and (128) of a second track (112). Both tracks (110) and (112) are integrally formed with frame beam structure (12) in the interior thereof. A support stand (180) for supporting the rearward end of frame (10) above the floor at a desired elevation is constructed with a plurality of upwardly open troughs (184A, 184B and 184C) which receive a lip portion (188) extending downwardly from rear crossmember (82) of the machine frame (10).

18 Claims, 5 Drawing Figures

OTHER PUBLICATIONS

Advertising brochure by Steyr-Daimler-Punch (GB) Ltd. for The Punch Jogger exercise treadmill.

Advertising brochure for the Models 2+2 and Track II rowing machines by Excel.

Advertising sheet for the Model Monark 633 rowing machine by Status One.

Advertising brochure for the Avita 850 and 950 rowing machines by M&R Industries, Inc.

Advertising brochure for the Model 5200 rowing machine by The West Bend Company.

Advertising brochure for the Models Hi-Rider, Continental 200, Continental 1000 and Continental Mark X by Shaw Mfg. Company, Inc.

Advertising brochure for the Healthmaster 1000, Healthmaster 1200 and Healthmaster 1400 rowing machines by Roadmaster Corporation.

Advertising brochure for the Executive Row 500 rowing machine by Status One.

Advertising brochure for the Lifestyler 1500 rowing machine by AMF.

Advertising brochure for the Aerobic Rower by Spartacus Manufacturing Co.

Advertising brochure for the Ever Young Professional Super Gold rowing machine by Shinn Fu Company of America Inc.

Precor Incorporated brochure illustrating 720 Incline Exerciser and 910ei elevating treadmill.

EXERCISE ROWING MACHINE

TECHNICAL FIELD

The present invention relates to exercise equipment, and more particularly to an exercise rowing machine.

BACKGROUND OF THE INVENTION

With the current increased awareness for the need for proper diet and physical exercise, new exercise equipment is being developed and advances are being made in existing equipment, including in exercise rowing machines. Modern exercise rowing machines provide a substantially complete workout; they may be used to exercise not only the muscles of the arms and legs, but also the muscles of the shoulders, lower back and stomach.

In general form, exercise rowing machines typically include a frame, a seat adapted to slide or roll along the frame for supporting the rower, and foot pedals for receiving and anchoring the feet of the rower. The rowing machine also includes a manually graspable handle, oars or similar members, which are pulled or pivoted toward the rower during the pull stroke while the rower simultaneously pushes against the foot pedals to straighten his legs, thereby causing the seat to roll or slide rearwardly along the frame. Various types of mechanical or hydraulic resistance mechanisms are employed for resisting the pull on the handle or oars by the rower. During the return stroke, the pull on the handle or oars is relaxed while the legs are simultaneously bent to allow the seat to roll or slide forwardly along the frame.

In one particular type of exercising rowing machine, as disclosed in Swedish Pat. No. 78,675, the seat is mounted on rollers that ride in tracks extending along opposite sides of an elongated frame. The tracks are constructed in the form of upwardly open channels. A transverse handle is gripped by the rower for pulling against a resistance mechanism in the form of an extension spring located beneath the frame. A cable interconnects one end of the spring with the handle and a pulley is mounted on the forward end of the frame around which the cable extends. During the pull stroke the rower simultaneously pushes against foot pedals to straighten his legs, thereby causing the seat to roll rearwardly, and pulls on the handle to extend the extension spring. During the return stroke the pull on the handle is relaxed while the legs are simultaneously bent to permit the seat to roll forwardly along the frame.

A somewhat similar type of rowing machine is disclosed by U.S. Pat. No. 4,284,272, with the exception that the handle is mounted on the upper end of a post to form a "T-handle", and the lower end of the post is pivotally mounted on the forward end of the frame. A resistance load is applied to the T-handle by a clock-type spring, rather than an extension spring. Also, the seat is mounted on rollers that ride over the exposed outer surface of a pair of spacedapart, longitudinal tubes that compose the frame. The rear end of the frame is supported above the floor by a crank-shaped, tubular support structure that may be rotated between an extended position supporting the frame off the ground and a retracted position wherein the rear end of the frame is resting on the ground for more compact storage of the machine when the machine is not in use.

In another type of exercise rowing machine, the lower ends of a pair of manually graspable oars are pivotally mounted on the machine frame. Hydraulic shock absorbers are pivotally connected between the forward end portions of the frame and intermediate locations along the length of the oars. During use, as the legs of the rower are being extended, the oars are stroked in a manner similar to the of a scull. A valve is integrated into the piston of the hydraulic shock absorber to allow metered flow of hydraulic fluid from one side of the piston to the other during stroking of the oars. Examples of this type of exercise rowing machine are disclosed in: U.S. Pat. Nos. D268,194; D268,278; and, UK Patent No. 2,120,560, and also is marketed by West Bend Company of West Bend, Wisconsin under the model designation "5200." In the '194 and '278 U.S. Patents, the seat is mounted on a carriage having rollers that ride on tracks in the form of a pair of parallel, spaced apart tubes extending '560 longitudinally of the frame. The outer surface of the rollers are concave to match the diameter of the tubes. In the West Bend Model 5200 rowing machine, the seat is supported by rollers that ride within tracks that are formed in the sides of the longitudinal center beam of the machine frame. The tracks are open in the laterally outward direction.

A common drawback of the above-discussed rowing machines is that the tracks on which the seat rollers ride are exposed and, thus, can be damaged by rough usage or by objects falling onto or otherwise hitting the tracks. Also, in the types of rowing machines having channel-type tracks, objects can be lodged in the channels, thereby preventing free movement of the rollers and possibly causing damage to the rollers. Also in many of the types of rowing machines discussed above, the level of resistance on the handle or oars can be selectively adjusted; however, the load on the legs of the rower is not adjustable, other than by virtue of the resistance on the handle or oars.

SUMMARY OF THE INVENTION

In accordance with the present invention the frame of an exercise apparatus is constructed with a beam structure having an internal track system for guiding the underlying carriage of a seat for travel along the beam structure. The track system includes a pair of guide rails disposed in spaced, parallel relationship to each other, with each of the guide rails having upper and lower rails disposed in aligned, vertically-spaced relationship to each other. Rollers, which are axled to the underframe of the carriage assembly, are disposed between and ride along the upper and lower rails. The carriage underframe extends downwardly from the seat, which is positioned slightly above the top of the beam structure, and into the interior of the beam structure.

In accordance with a further aspect of the present invention, the beam structure is constructed with narrow slots through which the carriage underframe extends into the interior of the beam structure. The beam structure is generally hollow in construction having a first component defining the bottom and side sections of the beam structure and having marginal portions extending along upper edge portions of the side sections of the beam structure. The beam structure also includes a second component disposed between a gap defined by the upper marginal portions of the first component thereby to cooperatively define a pair of narrow slots with the beam first component through which slots the carriage underframe extends.

In another aspect of the present invention the exercise apparatus includes an exercise rowing machine having a frame that includes an integral, forward substructure underlying the forward portion of the beam structure that extends longitudinally extending side members positioned on opposite sides of the beam structure. Forward and intermediate crossmembers transversely underlie the forward and intermediate portions of the beam structure to interconnect the forward and rearward end portions, respectively, of the side members. The exercise rowing machine also includes oars which are pivotally mounted to the rear end portions of the frame substructure side members, and resistance means in the form of linear actuators coupled between the forward end portions of the frame substructure side members and intermediate portions of the oars to provide resistance to the stroking of the oars.

In accordance with a further aspect of the present invention, a support stand is provided for elevating the rear end portion of the rowing machine frame at a selective height relative to the forward end portion of the frame. The support stand includes a plurality of vertically spaced apart, upwardly open grooves or troughs for receiving a tongue or lip which extends downwardly from the rear end portion of the rowing machine frame.

BRIEF DESCRIPTION OF THE DRAWINGS

The details of a typical embodiment of the present invention will be described in connection with an exercise rowing machine illustrated in the accompanying drawings, in which.

DESCRIPTION OF THE INVENTION

Figure 1:
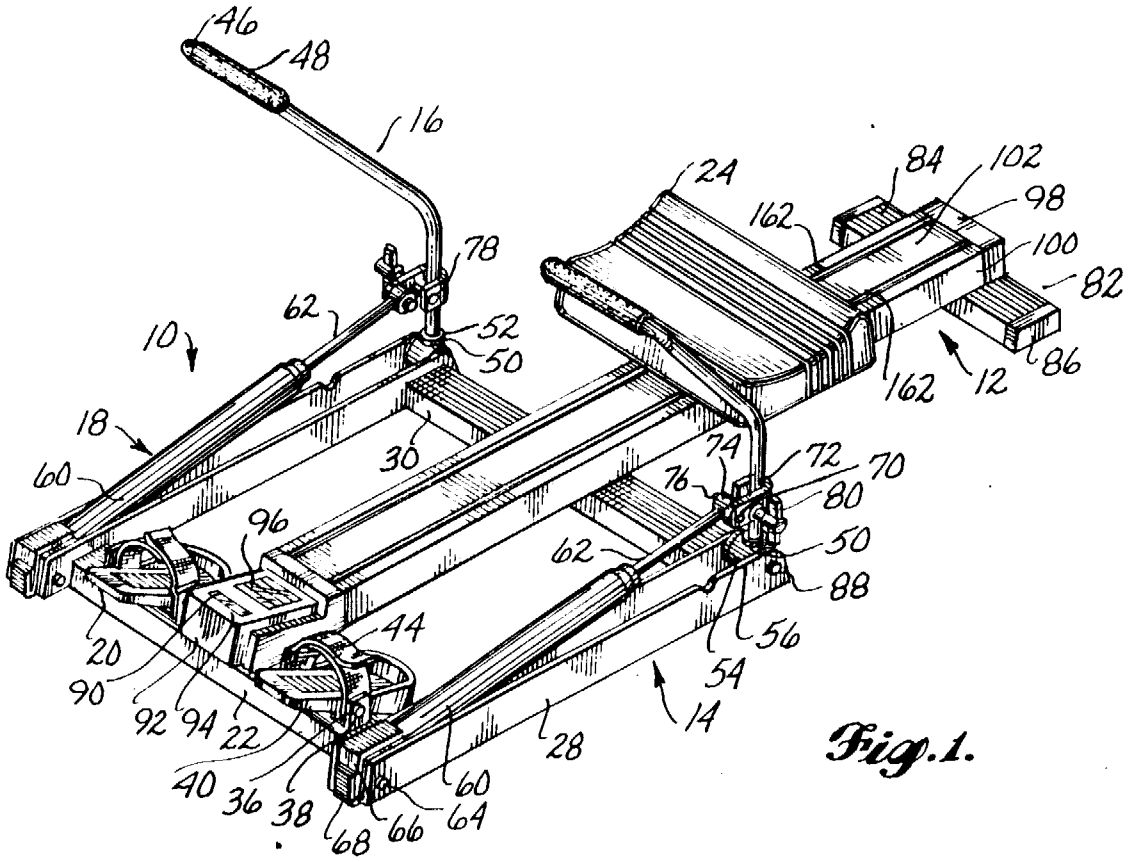
FIG. 1 is an isometric view of an exercise apparatus constructed according to the present invention in the form of an exercise rowing machine.
Figure 3:
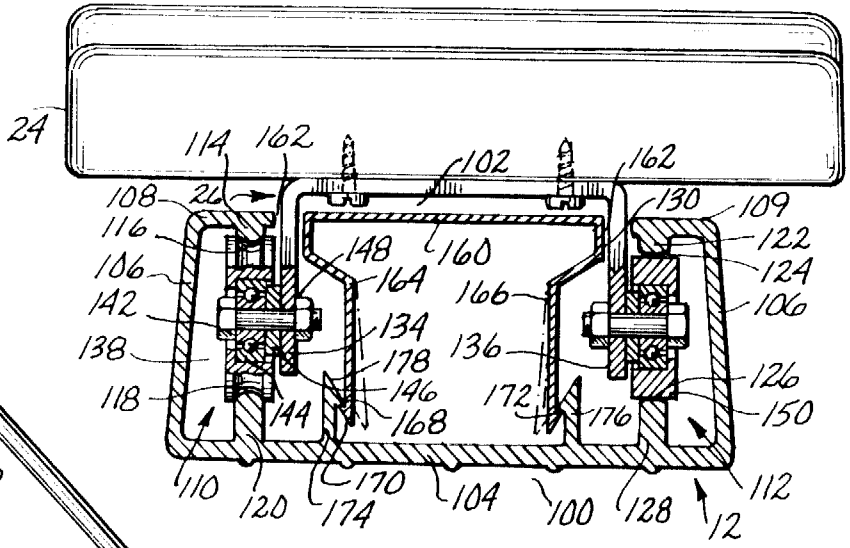
FIG. 3 is an enlarged, fragmentary cross-sectional view taken substantially along line 3—3 of FIG. 2.
Figure 2:
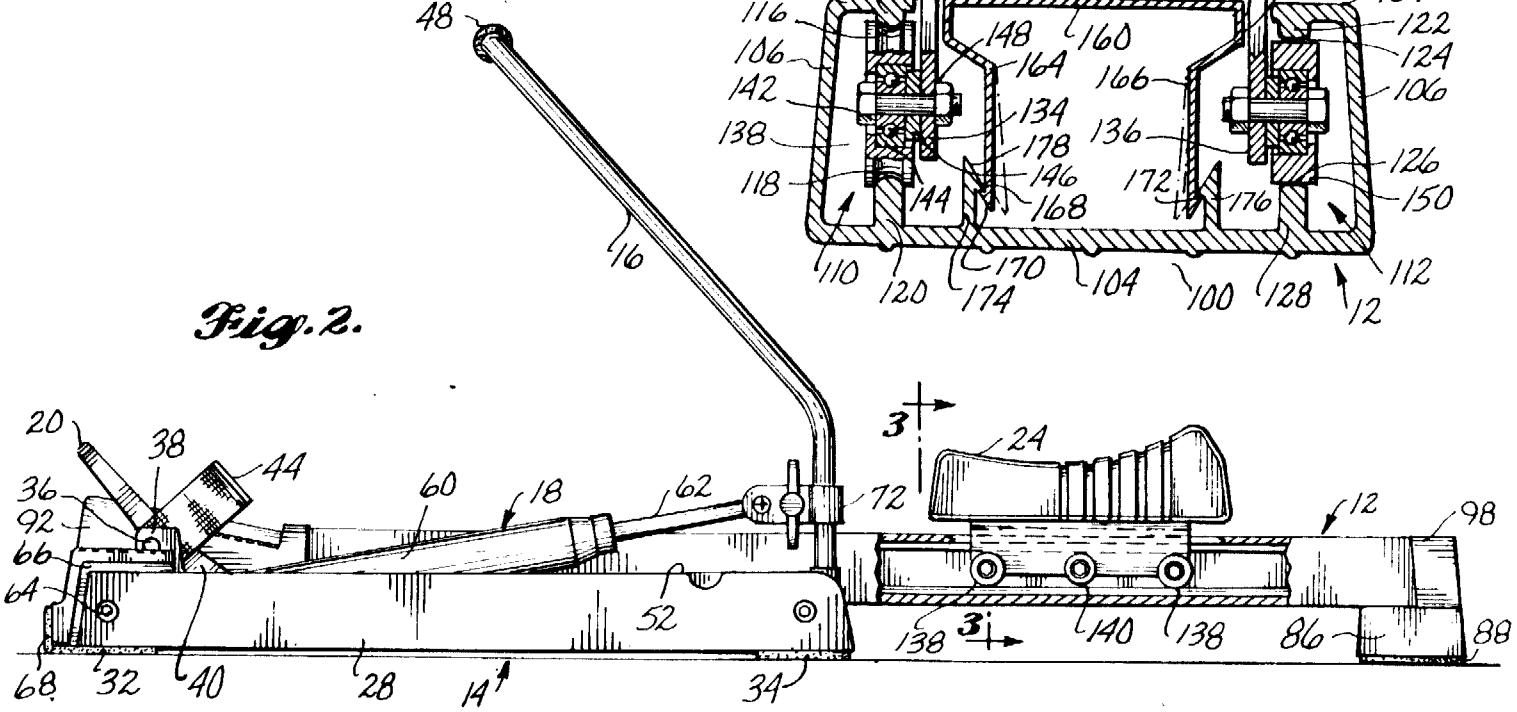
FIG. 2 is a side elevational view of the exercise rowing machine illustrated in FIG. 1, with portions broken away for clarity.

Referring initially to FIG. 1, a preferred embodiment of an exercise rowing machine constructed according to the present invention is illustrated as including a frame 10 composed of an elongated, substantially hollow beam structure 12 extending substantially the entire length of frame 10 and a substructure 14 underlying the forward portion of the beam structure. A pair of manually graspable oars 16 are pivotally mounted on rearward portions of the frame substructure. The forward ends of linear actuators 18 are pivotally coupled between the forward end of substructure 14 in intermediate positions along the height of oars 16. Foot pedals 20 are pivotally mounted on a forward crossmember 22 of substructure 14. Referring additionally to FIGS. 2 and 3, a seat 24 is mounted to an underlying carriage assembly 26 for supporting the seat for travel along the length of beam structure 12.

Next, describing specific aspects of the present invention in greater detail, referring primarily to FIG. 1, frame substructure 14 includes a pair of upwardly open side members in the form of channels 28 disposed in spaced relative relationship to each other on opposite sides of beam structure 12. The forward ends of channels 28 are interconnected by the forward crossmember 22 that extends transversely to and underlies the forward end portion of beam structure 12. The outer ends of crossmember 22 are fixedly attached to the inside flange walls of channels 28 by any appropriate means, such as by weldments, not shown, Crossmember 22 also supports the forward end of beam structure 12. Correspondingly, the rear end portions of channels 28 are interconnected by an intermediate crossmember 30 extending transversely beneath an intermediate portion of beam structure 12 to support the beam structure. The ends of crossmember 30 are fixedly attached to the inside flange walls of channels 28 by any appropriate means, such as by weldments, not shown, Ideally, but not essential, forward and intermediate crossmembers 22 and 30 are composed of high strength tubular material having a generally rectangularly shaped cross section to provide not only high structural integrity and light weight, but also flat bearing surfaces for supporting the underside of beam structure 12. As illustrated in FIG. 2, friction pads 32 and 34 are disposed beneath the undersides of the forward and rear end portions of channels 28 to assist in maintaining the rowing machine stationary when in use. Preferably, friction pads 32 and 34 are constructed from resilient, nonskid material, such as rubber or soft plastic.

A pair of foot pedals 20 are pivotally mounted on forward crossmember 22 at opposite sides of beam structure 12. To mount the foot pedals, a pin 36 extends through aligned openings formed in tabs 38 extending upwardly from the upper surface of forward crossmember 22 and through openings formed in upright flanges 40 extending along the sides of pedals 20. An E-ring, not shown, cotter pin, not shown, or other appropriate type of hardware may be engaged with the outer end portions of pin 36 extending outwardly of tabs 38 thereby to maintain engagement of the pivot pin with the tabs and pedals 20. The foot pedals are provided with straps 44 that extend over the top of the rowers feet to secure the feet to the foot pedals.

Manually graspable, tubular oars 16, formed in a "dogleg" shape, extend upwardly from the rear end portions of channels 28 to terminate at transverse handle portions 46 that are covered with snug fitting grips 48, preferably composed of soft, resilient material, such as foam rubber, to receive the hands of the rower. The lower ends of oars 16 are fixedly engaged within socket portions 50 of attachment collars 52. The attachment collars have circular body portions 54 disposed transversely to socket portions 50 to extend between the upright flanges of channels 28. Circular spacers 56 are disposed between each end of attachment collar body portion 54 and the adjacent upright flange of channels 28. A pin 58 extends transversely through aligned openings formed in the upright flanges of channel 28, through center openings formed in spacers 56 and through a central, close fitting clearance opening formed in body portion 54 of attachment collar 52 to engage a threaded nut, not shown, or other appropriate hardware. It will be appreciated that other arrangements may be employed to pivotally mount the lower ends of oars 16 to frame 10 without departing from the spirit or scope of the present invention.

A resistance generating device in the form of a linear actuator assembly 18 is pivotally coupled between the forward end of each channel 28 and selected positions along an intermediate section of each oar 16 to impose a resistance load against the rearward stroking of the oars by the rower. In one preferred embodiment of the present invention, the linear actuator assembly is composed of a fluid shock absorber having a cylinder portion 60, a piston (not shown) slidably disposed within the cylinder, and a piston rod 62 carried by the piston and extending outwardly in a rearward direction from the cylinder. The piston (not shown) is fitted with an appropriate valve mechanism (not shown) to allow passage of fluid, such as hydraulic oil, through the piston as rod 62 is extended and retracted relative to cylinder 60 during the stroking of oar 16. The construction of the fluid shock absorber 18 is well known in the art.

The forward ends of cylinders 16 are pivotally coupled to frame 10 by pins 64 extending through aligned openings formed in the forward end portions of the upright flanges of channel 28 and through a close fitting cross hole, not shown, formed in a coupling block, not shown, secured to the forward end of cylinder 60. A generally angle-shaped cover 66 extends horizontally across the forward portion of channel 28 and then downwardly along the forward end of the channel. Friction pad 32, noted above, includes a forward, upwardly extending section 68 that overlaps a portion of the forward face of cover 66. the forwrad section 68 of the friction pad assists in preventing the rowing machine from sliding or otherwise moving when stored in vertical orientation with the friction pad on the floor and the rear end portion of the rowing machine disposed in the air, such as leaning against a wall.

The rearward or free ends of piston rods 62 are adjustably secured to oars 16 along intermediate locations thereof to selectively vary the mechanical advantage achieved by the oars thereby obtaining the desired level of effort required to stroke the oars. To this end, a pin 70 extends through a clearance opening formed in the free end of the longer sidewall of a generally U-shaped sliding clamp 72 and through a close fitting opening formed in an eye 74 fixed to the rearward end of piston rod 62 to engage a nut 76 or other appropriate hardware member. Sliding clamp 72 is securely pressed against oar 16 at a selective location along the height of the oar by a second pin 78 extending through aligned openings formed in the two sidewalls of the clamp to engage a relatively large, manually operable wingnut 80. It will be appreciated that the closer sliding clamp 72 is located to handle portion 38, the less the mechanical advantage provided by the oar and, thus, the greater the work being expended by the rower during a given stroking distance of the oar.

Neither the oars 16, linear actuators 18 or foot pedals 20 per se constitute the present invention. However, they have been described with sufficient particularity to assist in understanding the overall operation of the rowing machine of the present invention and the importance of the novel aspects of the present invention in conjunction with the overall construction and operation of the exercise rowing machine illustrated in the figures. For instance, by constructing the rowing machine with a substructure 14, except for seat 24 and carriage assembly 26, substantially all of the movable components of the rowing machine may be assembled on the frame substructure while being supported by a single assembly fixture or jig thereby reducing the number of individual assembly stations or locations required during the assembly of the rowing machine. In addition, the components of substructure 14 itself may be welded or otherwise affixed together at a single work station thereby also facilitating the manufacture of the present invention. Frame substructure 14 may be assembled with beam structure 12 by hardware members, not shown, weldments or any other appropriate means.

Figure 5:
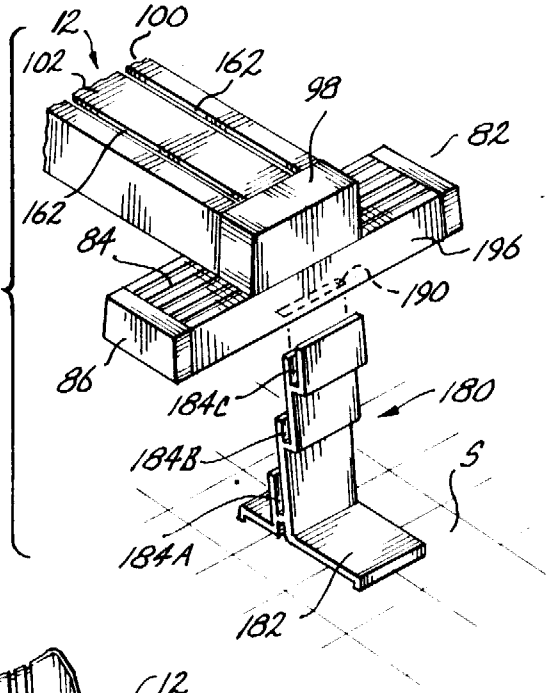

Referring specifically to FIGS. 1, 2 and 5 a rear crossmember 82 extends transversely beneath the rear end portion of beam structure 12, and is secured thereto by any appropriate means, such as by weldments or hardware members, not shown. As with forward and intermediate crossmembers 22 and 30, ideally rear crossmember 82 is tubular in construction and is generally of rectangular cross-sectional shape, having a flat top surface 84 to provide a substantial bearing surface for supporting the underside of beam structure 12. The outer ends of crossmember 82 are closed off by caps 86 that snugly engage over the crossmember. As shown in FIG. 2, preferably friction pads 88 are disposed beneath the undersides of each end of rear crossmember 82 to also assist in maintaining the rowing machine stationary when in use. As with friction pads 32 and 34, preferably friction pads 88 also are constructed from resilient, nonskid material, such as rubbeer or soft plastic.

Referring specifically to FIGS. 1–3, seat 24 is supported for travel along beam structure 12 by carriage assembly 26, which underlies the seat and extends downwardly into the interior of the beam structure. As most clearly shown in FIG. 2, beam structure 12 is substantially hollow and is shaped in a generally rectangular cross section similar to the cross-sectional shapes of crossmembers 22 and 30 of frame substructure 14 and rear crossmember 82. The rear end of beam structure 12 is closed off by an end cap 98 snugly engaging over the end of the beam. It is to be understood that beam structure 12 can be formed in other cross-sectional shapes without departing from the scope of the present invention.

An electronic display 90 is disposed within a housing 92 mounted on crossmember 22 at the forward end of beam structure 12. The upper surface 94 of housing 92 is canted upwardly so that display 90 is readily visible to the rower. Electrical circuitry, not shown, is disposed within housing 92 to calculate various workout parameters by employing electrical signals generated by sensing devices, not shown, mounted on the rowing machine. The workout parameters may include, for example, the elapsed time of the workout, the rate at which oars 16 are stroked, the total strokes of the oars, and the rate of work and total work (calories) expended by the rower. The particular workout parameter shown on display 90 may be controlled by selective depression of control panels 96 located on housing 92 below display 90.

Beam structure 12 is composed of a first or major component 100 forming the bottom and side sections of the beam structure and the side margins of the top section of the beam structure, and a second component 102 engageable with the first component to form the remainder of the top section of the beam structure, as discussed more fully below. As perhaps most clearly illustrated in FIG. 3, beam component 100 includes a flat, planar bottom section 104, planar side sections 106 extending upwardly from the bottom section and sloping slightly inwardly in the upward direction, and marginal top sections 108 and 109 extending transversely inwardly from the upper edges of side sections 106. The interior portion of beam component 100 is configured to define a pair of tracks 110 and 112 extending along the length of the beam structure in spaced, parallel relationship to each other. Track 110 is composed of an upper guide rail 114 depending downwardly from top marginal portion 108 to define a convex contact surface 116 disposed in vertically aligned, spaced, parallel relationship with a correspondingly-shaped convex contact surface 118 extending along the top of lower guide rail 120 that extends upwardly from bottom section 104 of beam component 100. In a similar manner, track 112 is composed of an upper guide rail 122 depending downwardly from the marginal portion 108 of beam component 102 to define a contact surface 124 disposed in vertically aligned, spaced, parallel relationship to a corresponding contact surface 126 extending along the top of lower guide rail 128 that extends upwardly from bottom section 104 of beam component 100. In cross section, contact surfaces 124 and 126 are only slightly curved, rather than being in a convex shape in the manner of contact surfaces 116 and 118.

Carriage assembly 26 is composed of a channel-shaped underframe 130 having a planar web portion that underlies the bottom of seat 24. A plurality of fasteners, for instance, in the form of screws 132, extend upwardly through clearance holes formed in the web portion of underframe 130 to engage the seat. Underframe 130 also includes substantially planar flange portions 134 and 136 that extend downwardly from seat 24 into the interior of beam structure 12. A pair of end rollers 138 and center roller 140 are axled on flange portion 134 to be disposed between rails 114 and 120 and to ride along rails 114 and 120, respectively. The end rollers 138, as shown in FIG. 3, include concave-shaped rim portion having a curvature corresponding to the convex curvatures of rail contact surfaces 116 and 118 so that rails 114 and 120 restrain rollers 138 in a lateral direction. The outer rim of center roller 140 also may be formed in a concave cross-sectional shape or may be substantially flat. End rollers 138 ride along contact surface 118 of lower guide rail 120 while center roller 140 rides along the contact surface 116 of upper guide rail 114. Ideally, a slight interference exists between the contact portions of the rims of rollers 140 and 138 and the rail contact surfaces 118 and 116 thereby to load the rollers against the guide rails to avoid any clearance between the rollers and their respective guide rails which in turn helps ensure that seat 24 rides smoothly along rail structure 12 without rocking laterally about tracks 110 or 112 or bounding or otherwise moving in the vertical direction.

Rollers 138 and 140 are secured to flange 134 by axles in the form of capscrews 142 extending through the inner races of ball bearings 144 pressed into the centers of the rollers, through spacers 146 and through close fitting clearance openings formed in flange portion 34 to threadably engage suitable hardware members, such as nuts 148. It is to be understood that ball bearings 144 may be replaced by other types of bearings, such as roller bearings, and that the bearings may be mounted on underframe 130 in a manner other than as specifically described above or illustrated in FIG. 3.

In a manner similar to end rollers 138 and center roller 140, a pair of end rollers 150 and center roller, not shown, are mounted on underframe flange 136 by capscrews 142 which extend through the inner race of ball bearings 144, through the center of spacer 146, through the clearance openings formed in flange portion 136 to threadably engage with nuts 148. The end rollers 150 ride along contact surface 126 of lower guide rail 128 while the center roller, not shown, rides along contact surface 124 of upper guide rail 122 in a manner corresponding to rollers 138 and 140 previously described. However, unlike rollers 138 and 140, the outer rims of end rollers 150 and a center roller, not shown, are substantially flat. This allows end rollers 150 and the center roller, not shown, to shift laterally relative to guide rails 122 and 128 in response to variations in the dimensions and to tolerances in the components of carriage assembly 26 and beam structure 12 which may result in variations in the spacing between tracks 110 and 112 and in variations in the spacing between rollers 138 and 140 and rollers 150. In the manner similar to end rollers 138 and center roller 150, ideally a slight interference exists between end rollers 150 and the center roller, not shown, and contact surfaces 124 and 126 thereby to help ensure constant engagement therebetween.

Continuing to refer specifically to FIG. 3, component 102 of beam structure 12 is constructed with a flat top portion 160 having an upper surface substantially coplanar with the upper surfaces of marginal portions 108 and 109 of beam component 100. The sides of top portion 160 are spaced laterally inwardly slightly from marginal portions 108 and 109 to define a pair of narrow, spaced, parallel slots 162 extending along the length of the beam structure 12 through which slots the flange portions 134 and 136 of underframe 130 extend. Beam component 102 also includes stepped sidewalls 164 and 166 that extend downwardly from top portion 160 to terminate at horizontal, laterally outwardly extending shoulders 168 and diagonal ramp portions 170 extending downwardly and laterally inwardly from the shoulders. Shoulders 168 of sidewalls 164 and 166 are adapted to bear against corresponding shoulders 172 extending horizontally and laterally outwardly from ridges 174 and 176 extending upwardly from beam bottom section 104. Ridges 174 and 176 are also constructed with ramp portions 178 extending upwardly and laterally outwardly from shoulders 172 at an angle of inclination generally corresponding to the angle of inclination of ramp portions 170 of sidewalls 164 and 166. By constructing the sidewalls 164 and 166 and ridges 174 and 176 in this manner, beam component 102 may be conveniently engaged with beam component 100 simply by pushing downwardly on component 102 so that ramp portions 170 slide downwardly along ramp portions 178 until shoulders 168 of sidewalls 164 and 166 engage shoulders 172 of ridges 174 and 176. Preferably, sidewalls 164 and 166 are nominally disposed slightly outwardly from their positions shown in FIG. 3 so that when beam component 102 is engaged with beam component 100, sidewalls 164 and 166 of beam component 102 press laterally outwardly against ridges 174 and 176 thereby maintaining beam component 102 in secure engagement with component 100. Beam component 102 may be disengaged from component 100, for instance to gain access to the rollers of carriage assembly 26, simply by removing beam end cap 98 and then sliding beam component 102 rearwardly relative to component 100.

As noted above, by the above construction, beam components 100 and 102 cooperatively define a pair of narrow, parallel, spaced-apart slots 162 through which the flanges 134 and 136 of underframe 130 extend. It will be appreciated that slots 162 are narrow enough to prevent the fingers or clothing of the rower or other objects from extending into the interior of the beam. Even if small objects pass through slots 162, they will fall to the bottom of the beam and not interfere with the operation of the rollers of the carriage assembly. It will be further appreciated that by the above construction of beam structure 12 and carriage assembly 26, the tracks 110 and 112 and the rollers of the carriage assembly are protected from damage caused by, for instance, rough handling of the rowing machine. In addition, by the carriage rollers being located within the interior beam structure 12, if lubricant leaks from bearings 144, such lubricant will be confined to the interior of the beam structure rather than soiling the floor or the clothing of the rower.

Figure 4:
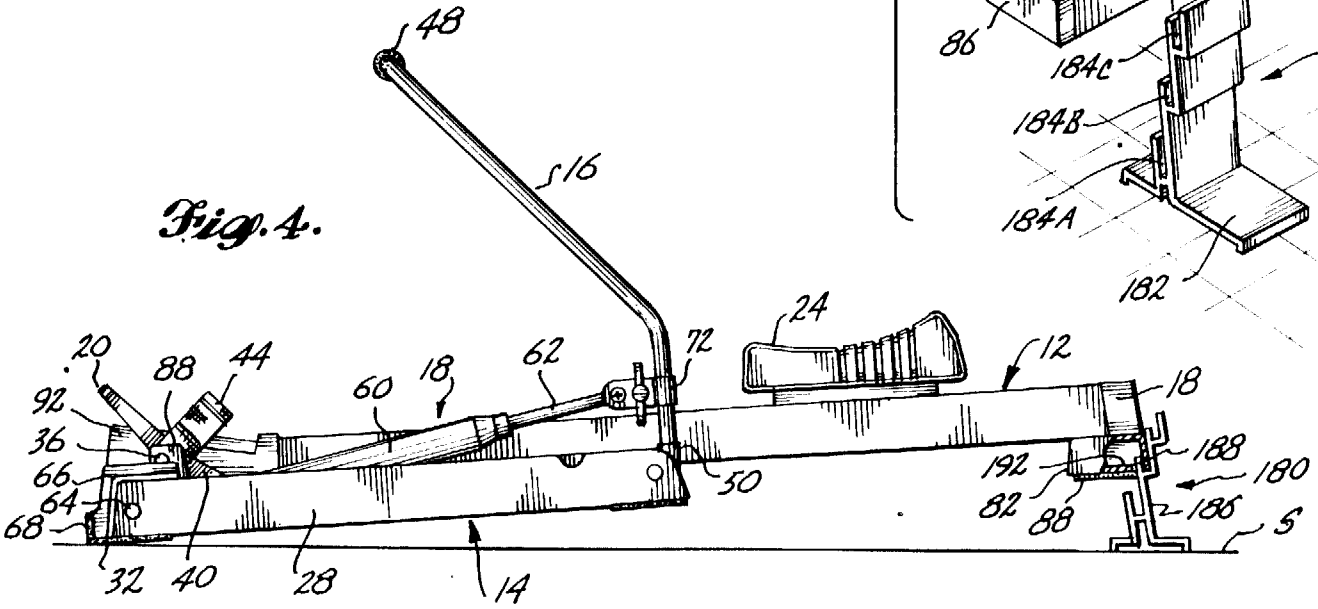
FIG. 4 is a side elevational view similar to FIG. 2, specifically illustrating the use of a support stand for elevating the rear end portion of the rowing machine; and, FIG. 5 is an enlarged, fragmentary, exploded, isometric view of the rear end portion of the exercise rowing machine shown in FIG. 4, specifically illustrating the construction of the support stand.

Next, referring specifically to FIGS. 4 and 5, a multi-position support stand 180 is provided for selectively supporting the rear end portion of frame 10 at desired elevations above the front end portion of the frame. The support stand is composed of a floor-engaging base 182 and a plurality of grooves or troughs 184A, 184B, and 184C that define upwardly open bight portions. Each of the grooves or troughs 184A, 184B and 184C are formed with a forward wall member and a rearward wall member, which rearward wall member, forms the forward wall member of the next higher groove or trough. For instance, rearward wall portion 186 of trough 184A forms the forward wall portion 188 of trough 184B. The forward wall portions of these troughs snugly engage upwardly through an opening 190 formed in the underside 192 of rear crossmember 182. As shown in FIG. 4, the forward and rearward walls defining each trough 184A, 184B, and 184C are inclined at an angle of inclination corresponding to that of rear wall 196 of crossmember 182. As also shown in FIG. 4, the portion of the rear wall 196 of crossmember 82 adjacent opening 190 functions as a lip or tongue that extends downwardly into a selected trough 184A, 184B or 184C. The forward and rearward walls of stand 180 defining each of the troughs snugly engage such lip or tongue to prevent relative movement in the direction longitudinal of frame beam structure 12 and support stand 180. As further illustrated in FIG. 4, when the rear end portion of frame 10 is elevated by use of stand 180, friction pads 32 help prevent movement of the forward end of frame 10 along the surface S on which the rowing machine lies.

It will be appreciated that by raising the rearward end of frame 10, the effort required by the rower to operate the rowing machine is increased, and especially the effort required by the legs of the rower. As noted above, the effort needed to stroke oars 16 may be adjusted by varying the position of sliding clamp 72 along the height of the oars. By also enabling the rear end of the rowing machine to be elevated, the rower may more specifically choose the level of workout he desires, especially on his legs.

As will be apparent to those skilled in the art to which the invention is stressed, the present invention may be embodied in forms other than those specifically disclosed above without departing from the spirit, scope or essential characteristics of the invention. The particular embodiments of the exercise rowing machine, described above, are therefore to be considered in all respects as illustrative and not restrictive. The scope of the present invention is as set forth in the appended claims, rather than being limited to the examples of the exercise rowing machines as set forth in the foregoing description.

The embodiments of the invention in which an exclusive property or privilege is claimed are defined as follows:

1. An exercise apparatus, comprising:

a frame including an elongaged, generally tubular beam assembly, comprising:

(a) a first component having a bottom portion forming the bottom exterior of the beam assembly, side portions forming the exterior sides of the beam assembly and top portions extending laterally inwardly from the side portions to form exterior top flanges of the beam assembly and to define a gap therebetween extending longitudinally of the beam assembly;

(b) a second component cooperatively engageable and disengageable with the first component of the beam assembly, said second component being generally U-shaped in cross section and defined by:

(i) a top wall extending between the top portions of the first component of the beam assembly to, in conjunction with the top portion of the first component, substantially close off the top section of the beam assembly and define elongated entrance openings in the form of a pair of narrow slots disposed in spaced parallel relationship to each other and extending along the length of the beam assembly; and, (ii) laterally spaced apart side walls extending downwardly from the lateral edge portions of the top wall; and, (c) means for detachably engaging the lower portions of the side walls of the second component of the beam assembly to the bottom portion of the first component whereby the second component of the beam assembly and the bottom portion of the first component cooperatively form a closed, hollow structure extending longitudinally of the beam assembly;

internal track means disposed within the interior of the beam assembly, said internal track means including a pair of guide rails disposed outwardly and on opposite sides of the second component of the beam assembly and positioned in spaced parallel relationship to each other;

a seat; and, a carriage assembly having an underframe for supporting the seat, said underframe extending downwardly through said beam assembly entrance openings and into the interior of said beam assembly, and a plurality of roller means rotatably secured to said underframe and engageable with said guide rails for guiding the carriage assembly for travel along the length of the beam assembly.

2. The exercise apparatus according to claim 1, wherein at least one of said guide rails includes upper and lower rails in aligned, vertically spaced-apart relationship to each other to engage both upper and lower portions of said carriage roller means.

3. The exercise apparatus of claim 1, wherein said seat extends laterally outwardly from the exterior sides of the beam assembly.

4. The exercise apparatus according to claim 1, wherein said means for detachably engaging the lower portions of the side walls of the second component include a pair of laterally spaced-apart, parallel engagement members extending upwardly from the bottom portion of the first component; and, the lower portions of the side walls of the second components of the beam assembly being nominally spaced apart from each other at a width which is greater than the width separating the engagement members, whereby the lower end portions of the side walls of the second component are flexed inwardly when in engaged position with corresponding engagement members.

5. The exercise apparatus according to claim 1, wherein, the beam assembly is generally rectangular in cross section, having a generally planer top section cooperatively defined by the top portions of the beam assembly first component and the top wall of the beam assembly second component, a generally planar bottom section defined by the bottom portion of the beam assembly first component and side sections interconnecting the top and bottom sections, said side sections defined by the side portions of the beam assembly first component; and, said slots extending along the top section of the rectangular beam assembly.

6. The exercise apparatus according to claim 1, further including means for elevating one end of the frame relative to the opposite end.

7. The exercise apparatus according to claim 6, wherein the elevatable end portion of the frame includes downwardly depending lip means;

said elevating means include a support stand comprising a plurality of vertically spaced, upwardly open bight portions; and, wherein said lip means engageable within a selective bight portion to support the elevatable end of the frame at a desired elevation relative to the opposite end of the frame.

8. A rowing machine having a frame composed of a beam assembly extending substantially along the entire length of the frame, a seat adaptable to travel along the beam assembly, at least one oar pivotally mounted on the frame, and resistance means for resisting the stroking of the oar, an improvement comprising:

track means integral with, disposed within the interior of, and extending longitudinally along the beam assembly;

wherein the beam assembly comprises:

(a) a first component having a bottom portion forming the bottom exterior of the beam assembly, side portions forming the exterior side portions of the beam assembly said track means being integrally formed with said first component and disposed on opposite sides of said second component side walls; and top portions extending laterally inwardly from the side portions to form top exterior flanges of the beam assembly and to define a gap therebetween extending longitudinally of the beam assembly;

(b) a second component cooperatively engagable and disengagable with the first component of the beam assembly, said second component beam generally U-shaped in cross section and defined by:

(i) a top wall extending between the top portions of the first component of the beam assembly to, in conjunction with the top portions of the first component, define a pair of narrow entrance slots disposed in spaced parallel relationship to each other and extending along the length of the beam assembly; and, (ii) laterally spaced apart side walls extending downwardly from the lateral edge portions of the top wall; and (c) means for detachably attaching the lower portions of the side walls of the second component of the beam assembly to the bottom portion of the first component whereby the second component of the beam assembly and the bottom portion of the first component cooperatively form a hollow structure extending longitudinally of the beam assembly; and, a carriage assembly for supporting the seat, said carriage assembly having;

(a) an underframe extending from said seat downwardly through said entrance slots and into the interior of the beam assembly; and, (b) roller means connected to said underframe and engaged with said track means for guiding said carriage assembly for travel along the beam assembly.

9. The improvement according to claim 8, wherein at least one of said guide rails includes upper and lower rails disposed in aligned vertically spaced relationship to each other to engage both upper and lower portions of said roller means.

10. A rowing machine according to claim 8, wherein the lower portions of the side walls of the second component of the beam assembly are flexed inwardly toward each other when in engaged position with said detachable engaging means.

11. The improvement according to claim 8, including an improved frame comprising an integral forward substructure underlying the forward portion of the beam assembly said forward substructure comprising:

a pair of longitudinally extending side members disposed on opposite sides of the beam assembly;

a forward crossmember extending transversely to the forward portion of the beam assembly and interconnecting the forward end portions of the side members;

an intermediate crossmember transversely underlying an intermediate portion of the beam assembly and interconnecting the rearward end portions of the side members;

wherein the oars are pivotally mounted to rear end portions of the side members; and, wherein the resistance means are connected to forward end portions of the side members.

12. The improvement according to claim 8, further comprising means for elevating the rearward end portion of the frame relative to the forward end portion of the frame.

13. The improvement according to claim 12, wherein said elevating means comprise:

tongue means extending downwardly from the rear end portion of the frame; and, support stand means having a plurality of vertically spaced-apart, upwardly open receiving grooves for receiving said tongue means to support the rear end portion of the frame at the desired elevation relative to the forward end portion of the frame.

14. A beam assembly for the frame of an exercise apparatus having a seat supported by an underlying carriage assembly for travel along the beam assembly, said carriage having a plurality of roller means, said beam assembly comprising:

(a) a first component having a bottom portion forming the bottom exterior of the beam assembly, side portions forming the exterior sides of the beam assembly and top portions extending laterally inwardly from the side portions to form exterior top flanges of the beam assembly and to define a gap therebetween extending longitudinally of the beam assembly;

(b) a second component cooperatively engageable and disengageable with the first component of the beam assembly, said second component including:

(i) a top wall extending between the exterior top flanges of the beam assembly to define a pair of elongated, narrow entrance slots extending along the length of the beam assembly adjacent the exterior top flanges for reception of portions of said carriage assembly into the interior of said beam assembly; and (ii) laterally spaced-apart side walls extending downwardly from the lateral edge portions of the top wall;

(c) means extending upwardly from the bottom portion of the first component for detachably engaging the lower portions of the side walls of the second component of the beam assembly whereby the second component of the beam assembly and the bottom portion of the first component cooperatively define a closed hollow structure extending longitudinally of the beam assembly; and, (d) internal track means integrally formed with the first component of the beams assembly, said internal track means including a pair of guide rails extending upwardly from the bottom portion of the beam assembly first component at locations on opposite sides of the beam assembly second component for engagement with said roller means of said carriage assembly for guiding the carriage assembly for travel along the length of the beam assembly.

15. The beam structure according to claim 14, wherein said means for detachably engaging the lower portions of the side walls of the second component of the beam assembly to the bottom portion of the first component comprise:

a pair of elongate, laterally spaced apart ridges extending upwardly from the bottom portion of the first component; and the lower portions of the side walls of the second component being nominally spaced-apart from each other at a width greater than the width separating the said ridges, whereby the side walls of the second component being flexed inwardly toward each other when engaged with said ridges.

16. The beam assembly according to claim 14, wherein said track means includes a pair of guide rails formed by interior portions of said beam assembly, said guide rails disposed in spaced, parallel relationship to each other.

17. The beam assembly according to claim 16, wherein at least one of said guide rails includes upper and lower rails in aligned, vertically spaced-apart relationship to each other to engage both upper and lower portions of said carriage roller means.

18. The beam assembly according to claim 16, wherein said beam assembly in exterior cross section is composed of a generally closed rectilinear form having:

a generally planar bottom exterior section formed by the bottom portion of the first component;

an exterior top section cooperatively defined by the top portions of the beam assembly first component and the top wall of the beam assembly second component; and, generally planar exterior side sections interconnecting the top and bottom sections, said side sections defined by the side portions of the beam assembly first component.

* * * * *

UNITED STATES PATENT AND TRADEMARK OFFICE

CERTIFICATE OF CORRECTION

PATENT NO. : 4,695,050

DATED : September 22, 1987

INVENTOR(S) : David B. Smith et al.

It is certified that error appears in the above-identified patent and that said Letters Patent is hereby corrected as shown below:

Under "OTHER PUBLICATIONS" (second page), lines 11 and 12, "Continental 200" should be -- Continental 2000 --.

Column 1, line 59, "spacedapart" should be -- spaced-apart --.

Column 2, line 16, insert the following after "in the form of":

-- a raised rim or bead extending along the upper side edges of a longitudinal central beam which composes a major element of the frame of the machine. In the UK '560 patent, the seat is mounted on rollers that ride on tracks in the form of --

Column 2, line 17, delete " '560 " after "extending".

Column 4, line 12, the comma (,) after "shown" should be a period (.)

Column 4, line 20, the comma (,) after "shown" should be a period (.)

Column 5, line 31, "the" should be -- The --.

Column 5, line 31, "forwrad" should be -- forward --.

Column 10, line 7, "elongaged" should be -- elongated --

Column 11, line 28, after "wherein" insert a semicolon (:)

Column 12, line 15, "having;" should be -- having: --.

UNITED STATES PATENT AND TRADEMARK OFFICE

CERTIFICATE OF CORRECTION

PATENT NO. : 4,695,050

DATED : September 22, 1987

INVENTOR(S) : David B. Smith et al.

It is certified that error appears in the above-identified patent and that said Letters Patent is hereby corrected as shown below:

Column 12, line 36, after "assembly" insert a comma (,).

Signed and Sealed this

Twenty-first Day of June, 1988

*Attest:*

DONALD J. QUIGG

*Attesting Officer*

*Commissioner of Patents and Trademarks*